US006719525B2

(12) United States Patent
Chen

(10) Patent No.: US 6,719,525 B2
(45) Date of Patent: Apr. 13, 2004

(54) SUBMERGED MOTOR VANE WHEEL ROTATION DIRECTION CONTROL STRUCTURE

(76) Inventor: Chi-Der Chen, 85-1, Shuiyuan Road, Taipei (TW)

( * ) Notice: Subject to any disclaimer, the term of this patent is extended or adjusted under 35 U.S.C. 154(b) by 217 days.

(21) Appl. No.: 10/027,543

(22) Filed: Dec. 20, 2001

(65) Prior Publication Data

US 2003/0118441 A1 Jun. 26, 2003

(51) Int. Cl.[7] ..... F04D 15/00

(52) U.S. Cl. ..... 415/14; 415/141; 417/423.3

(58) Field of Search ..... 415/141, 123, 415/19, 140, 206; 417/423.3, 214

(56) References Cited

U.S. PATENT DOCUMENTS 5,711,657 A * 1/1998 Hoffmeier ..... 417/319

* cited by examiner

*Primary Examiner*—Edward K. Look
*Assistant Examiner*—Kimya N McCoy
(74) *Attorney, Agent, or Firm*—Pro-Techtor International Services

(57) ABSTRACT

A submerged motor vane wheel rotation direction control structure includes a blade pivoted to a locating block inside of the water guide chamber of a submerged motor, a vane wheel, the vane wheel having sloping teeth radially extended from the motor shaft of the submerged motor, which push the blade outwards toward to an open position for the passing of flow of water upon clockwise rotation of the vane wheel, and is forced into engagement with the blade to hold the blade in a close position upon counter-clockwise rotation of the vane wheel, causing the submerged motor to reverse the vane wheel.

8 Claims, 6 Drawing Sheets

SUBMERGED MOTOR VANE WHEEL ROTATION DIRECTION CONTROL STRUCTURE

BACKGROUND OF THE INVENTION

The present invention relates to a submerged motor and, more specifically, to a submerged motor vane wheel rotation direction control structure, which controls the direction of rotation of the vane wheel, preventing the formation of a turbulent flow, and improving the water pumping efficiency of the motor.

A regular submerged motor for use in an aquarium generally comprises a water guide chamber, a water intake pipe at the front side of the water guide chamber, a drain pipe at the left or right side of the water guide chamber, and a vane wheel. When rotating the vane wheel, water is drawn into the water intake pipe and then driven out of the drainpipe to the aquarium directly or through a water filter, so as to provide oxygen to the water in the aquarium or to remove solid mater from the water.

Conventional submerged motors cannot fully carry out water pumping efficiency. Because the motor shaft is caused to rotate by means of the action of the surrounded magnetic coil, the submerged motor cannot control the direction of rotation of the vane wheel when started. When rotated in the reversed direction (in case the drain pipe is at the left side in favor of clockwise direction), water is drawn into the water guide chamber in rush, causing a turbulent flow. Upon counter-clockwise rotation of the vane wheel, water is forced toward the inner side of the drainpipe by a centrifugal force. Due to limited space between the vane wheel and the periphery of the water guide chamber, the turbulent flow of water cannot be smoothly guided out of the submerged motor through the drainpipe. In case the drainpipe is at the right side in favor of counter-clockwise direction, forward rotation of the vane wheel will also causes a turbulent flow of water.

SUMMARY OF THE INVENTION

The present invention has been accomplished to provide a submerged motor vane wheel rotation direction control structure, which eliminates the aforesaid drawbacks. It is therefore the main object of the present invention to provide a submerged motor vane wheel rotation direction control structure, which automatically controls the rotation direction of the vane wheel of the submerged motor, preventing the formation of a turbulent flow and, enabling intake flow of water to be smoothly guided out of the submerged motor through the drain pipe of the motor. According to one embodiment of the present invention, the submerged motor vane wheel rotation direction control structure a locating block provided at the vane wheel in the water guide chamber of a submerged motor, said locating block comprising a coupling groove, and a hooked portion perpendicularly disposed at one side of said coupling groove; a blade pivoted to the coupling groove of the locating block and secured in place by a cover plate; and a plurality of sloping teeth equiangularly spaced around the inside wall of the water guide chamber of the submerged motor. In an alternate form of the present invention, the sloping teeth are provided at the vane wheel, the locating block is fixedly provided inside the water guide chamber, and the blade is pivoted to the locating block inside the water guide chamber.

DETAILED DESCRIPTION OF THE PREFERRED EMBODIMENT

Figure 1:
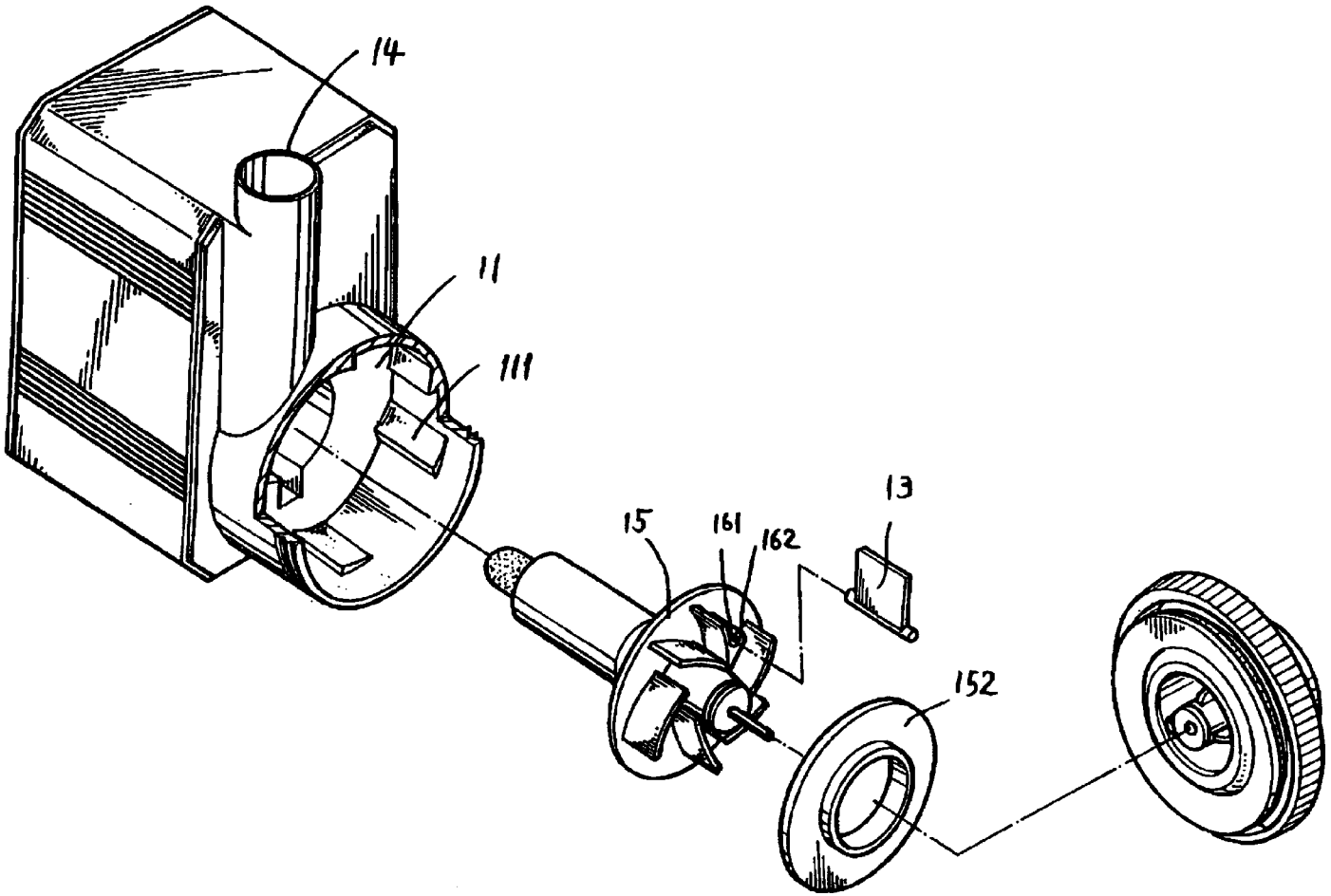
FIG. 1 is an exploded view of a first embodiment of the present invention.

Referring to FIG. 1, a blade 13 is pivoted to a coupling groove 161 in a fixed locating block 16 at the vane wheel, referenced by 15. The locating block 16 further comprises a hooked portion 162 perpendicularly disposed at one side of the coupling groove 161. A cover plate 152 is covered on the front side of the vane wheel 15 to hold the blade 13 in place. The water guide chamber, referenced by 11 has a plurality of teeth 111 of smoothly arched cross-section equiangularly spaced around the inside wall thereof. A drainpipe 14 is provided at the left side of the water guide chamber 11 (clockwise direction). The drainpipe 14 may be provided at the right side of the water guide chamber 11 (counter-clockwise direction). In this case, the locating block 16 and the blade 13 are provided at the vane wheel 15 in the reversed side.

Figure 2:
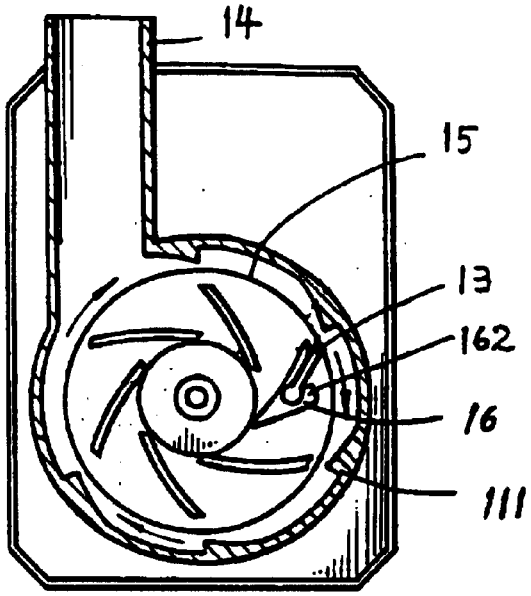
FIG. 2 is a sectional view showing the action of the first embodiment of the present invention upon clockwise rotation of the vane wheel.
Figure 3:
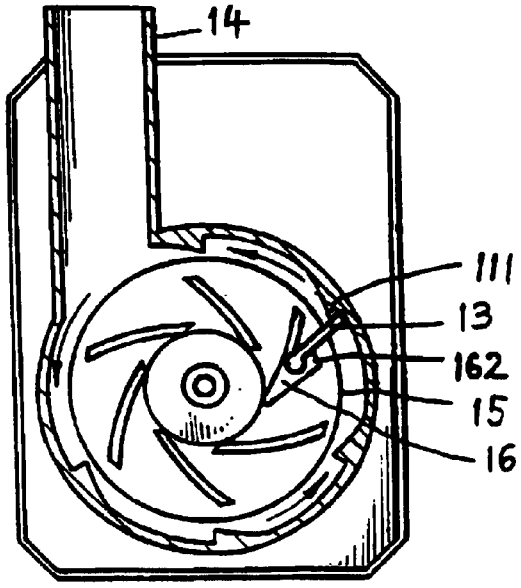
FIG. 3 is a sectional view showing the action of the first embodiment of the present invention upon counter-clockwise rotation of the vane wheel.

Referring to FIG. 2, when the vane wheel 15 is rotated clockwise, the forward flow of water forces the blade 13 outwards, therefore the forward flow of water is allowed to pass to the outside through the drainpipe 14. On the contrary, as shown in FIG. 3, when rotating the vane wheel 15 counter-clockwise, the reversed flow of water forces the blade 13 inwards toward the center of the vane wheel 15 to interfere with the reversed rotation of the vane wheel 15, thereby causing the submerged motor to reverse the direction of ration of the vane wheel 15 from the counter-clockwise direction to the clockwise direction. When reversed, the forward flow of water forces the blade 13 from the close position shown in FIG. 3 to the open position shown in FIG. 2. At this time, the blade 13 is stopped at one sloping tooth 111 in the water guide chamber 11 and the hooked portion 162 limits the maximum turning angle of the blade 13, and therefore the forward flow of water passes to the outside of the submerged motor through the drain pipe 14 again.

Figure 4:
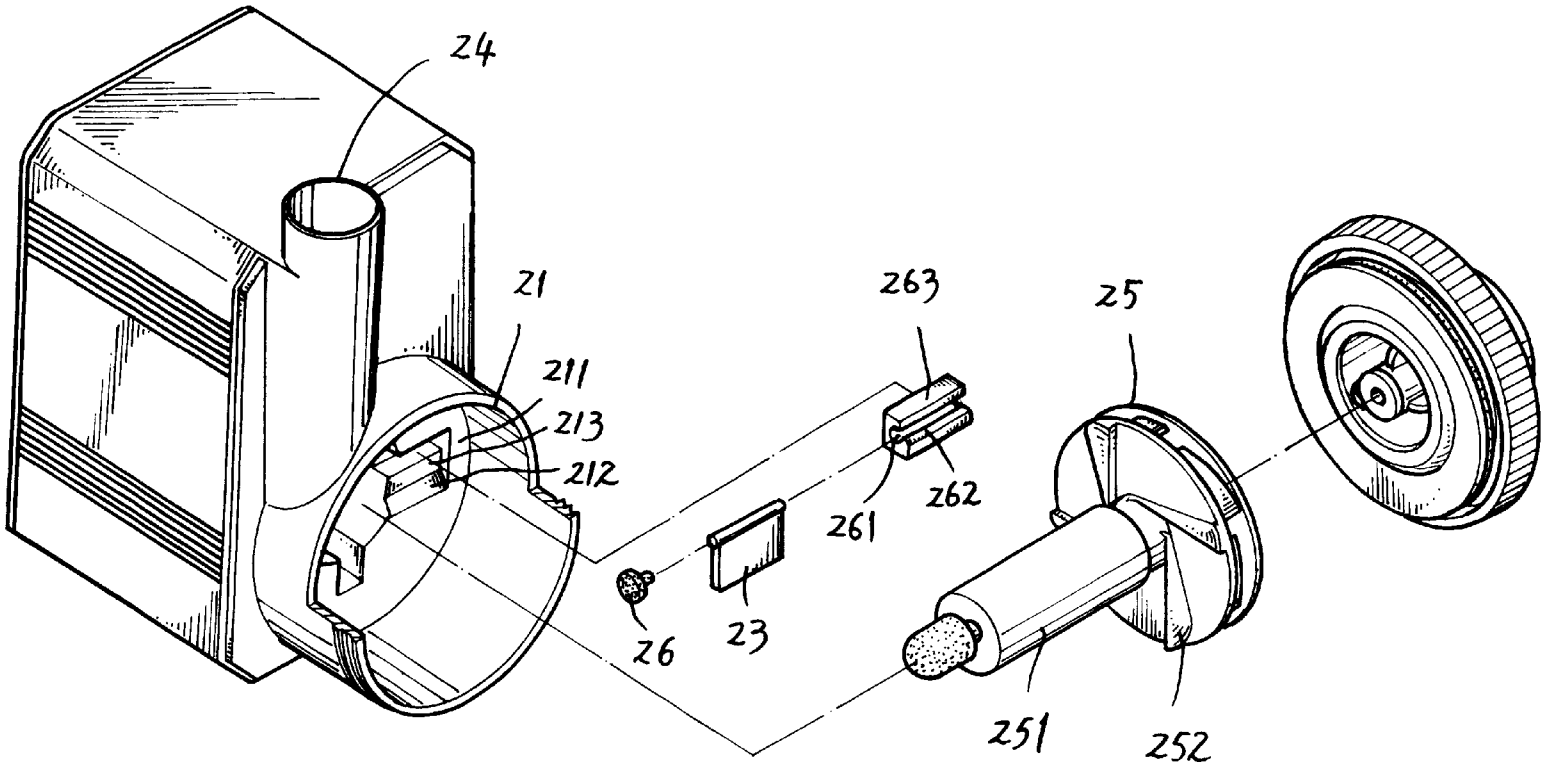
FIG. 4 is an exploded view of a second embodiment of the present invention.

FIG. 4 shows a second embodiment of the present invention. According to this embodiment, the water guide chamber 21 has an end wall 211. The end wall 211 comprises a sloping face portion 212, a straight face portion 213 downwardly extended from the sloping face portion 212, and a bearing face portion 214 perpendicularly outwardly extended from the bottom side of the straight face portion 213. A locating block 26 is fixedly mounted on the bearing face portion 214 and closely attached to the straight face portion 213. The locating block 26 has a longitudinal coupling groove 261 extended through two distal ends thereof, a hooked portion 262 disposed at one side of the longitudinal coupling groove 261, and a tongue 263 disposed at the other side of the longitudinal coupling groove 261. A blade 23 is pivotally coupled to the longitudinal coupling groove 261 of the locating block 26. A stopper 26 is fastened to one end of the locating block 26 to stop the blade 23 in the longitudinal coupling groove 261 of the locating block 26. The vane wheel, referenced by 25, has sloping teeth 252 radially extended from the motor shaft 251.

Figure 5:
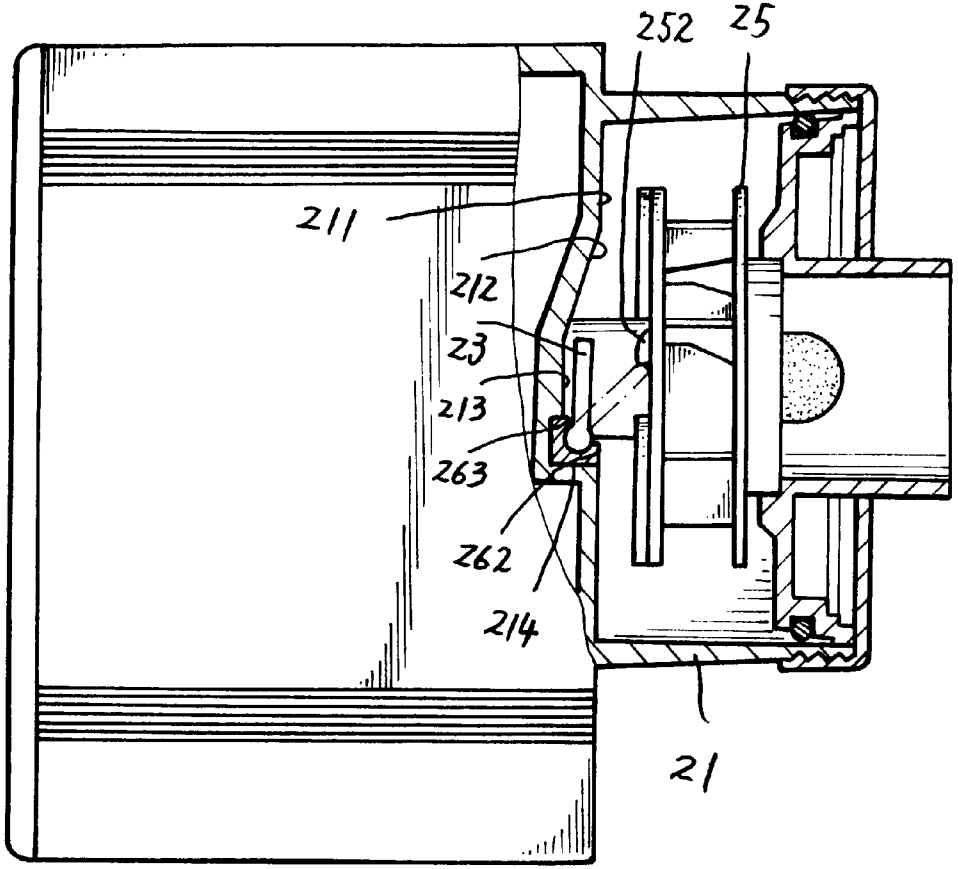
FIG. 5 is a sectional view showing the action of the second embodiment of the present invention.

Referring to FIG. 5. When rotating the vane wheel 15 in clockwise direction, the forward flow of water forces the blade 23 downwards to the tongue 263, and therefore the forward flow of water is allowed to pass to the drainpipe, referenced by 24. On the contrary, when rotating the vane wheel 15 in counter-clockwise direction, the flow of water passes to the space in between the straight face portion 213 and the tongue 263 to force the blade 23 outwards into engagement with one sloping teeth 252, thereby causing the submerged motor to change the direction of rotation. At this time, the hooked portion 262 limits the maximum turning angle of the blade 23. When the submerged motor changed the direction of rotation, the blade 23 is forced back to the side at the tongue 263.

Figure 6:
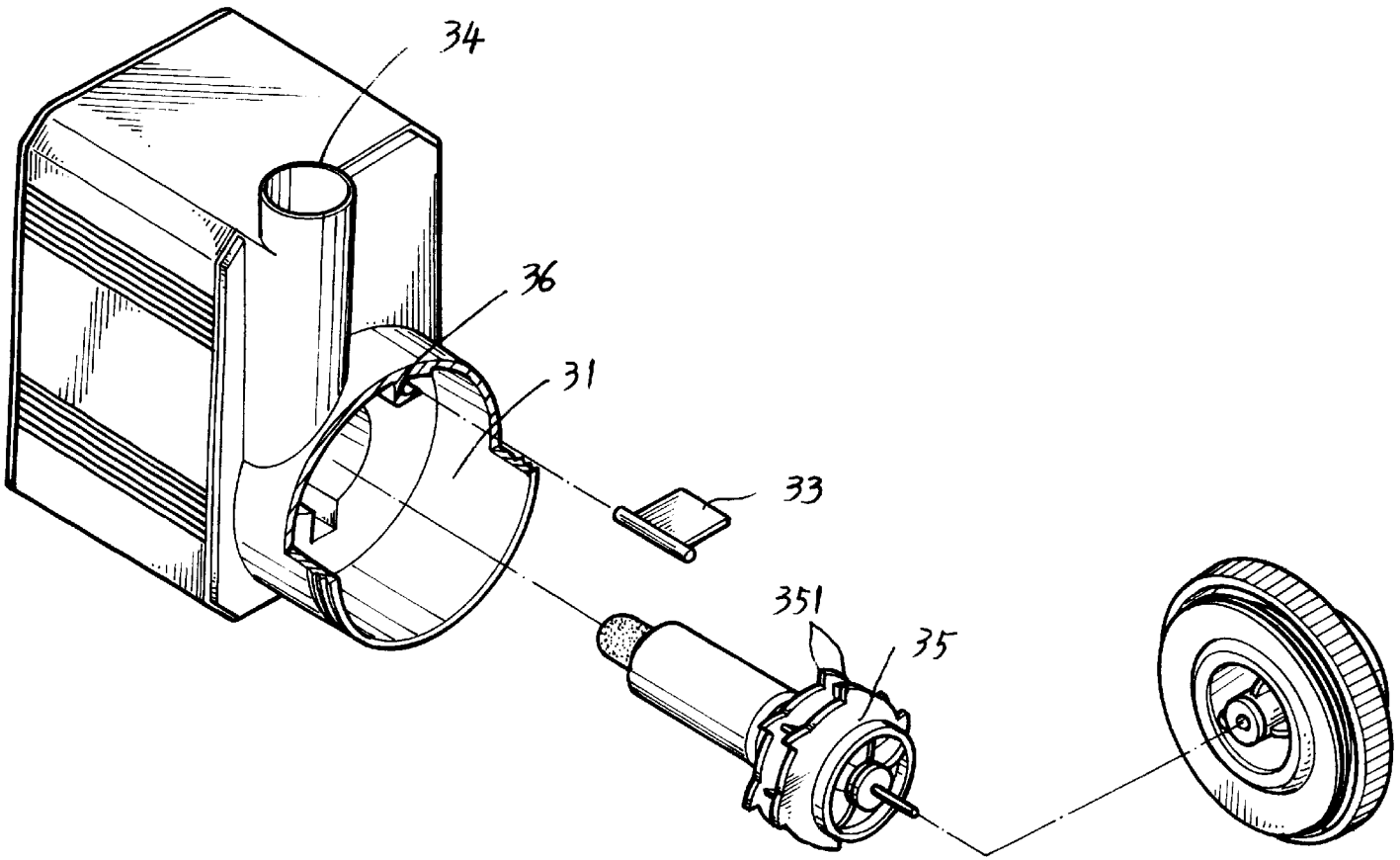
FIG. 6 is an exploded view of a third embodiment of the present invention.

FIG. 6 shows a third embodiment of the present invention. According to this embodiment, a locating block 36 is provided inside the water guide chamber, referenced by 31. The structure and mounting arrangement of the locating block 36 are same as the aforesaid second embodiment of the present invention. A blade 33 is pivoted to the locating block 36. The vane wheel, referenced by 35, has sloping teeth 351 equiangularly spaced around the periphery and adapted for engaging the blade 33.

Figure 7:
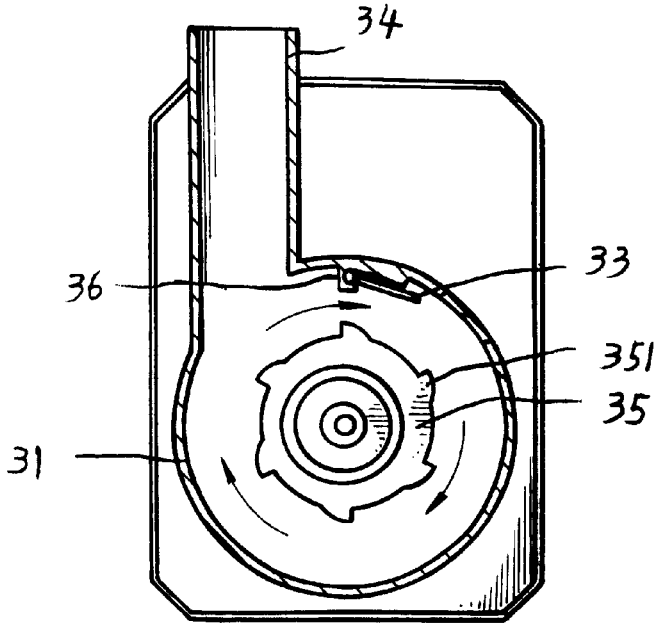
FIG. 7 is a sectional view showing the action of the third embodiment of the present invention upon clockwise rotation of the vane wheel.
Figure 8:
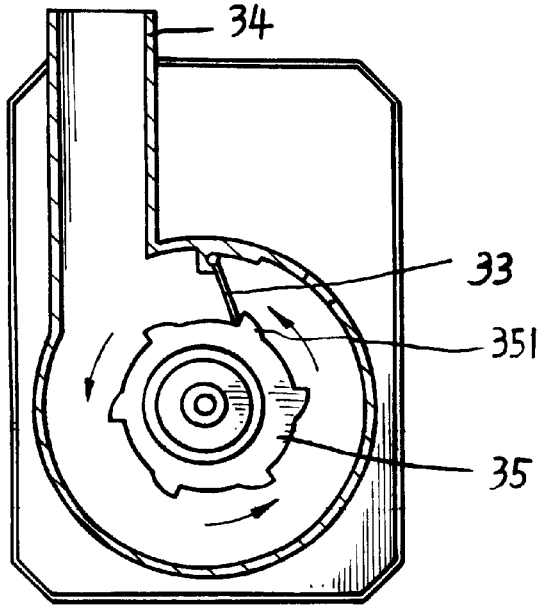
FIG. 8 is a sectional view showing the action of the third embodiment of the present invention upon counter-clockwise rotation of the vane wheel.

FIGS. 7 and 8 show the operation of the aforesaid third embodiment. When rotating the vane wheel 35 in clockwise direction, the forward flow of water forces the blade 33 outwards, and passes to the outside of the submerged motor (see FIG. 7). On the contrary, when rotating the vane wheel 35 in counter-clockwise direction, the reversed flow of water forces the blade 33 outwards into engagement with the sloping teeth 351 of the vane wheel 35 (see FIG. 8), thereby causing the submerged motor to change the direction of rotation of the vane wheel 35. When changed from counter-clockwise direction to clockwise direction, the blade 33 is turned outwards to the open position s for enabling the forward flow of water to pass to the outside of the submerged motor through the drain pipe, referenced by 34.

A prototype of submerged motor vane wheel rotation direction control structure has been constructed with the features of FIGS. 1~8. The submerged motor vane wheel rotation direction control structure functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A submerged motor vane wheel rotation direction control structure comprising:

a locating block provided at the vane wheel in the water guide chamber of a submerged motor, said locating block comprising a coupling groove, and a hooked portion perpendicularly disposed at one side of said coupling groove;

a blade pivoted to said coupling groove of said locating block and secured in place by a cover plate; and a plurality of sloping teeth equiangularly spaced around the inside wall of the water guide chamber of said submerged motor.

2. The submerged motor vane wheel rotation direction control structure as claimed in claim 1 wherein said teeth each have a smoothed arched cross section.

3. A submerged motor vane wheel rotation direction control structure comprising:

a locating block provided inside the water guide chamber of a submerged motor, said locating block comprising a coupling groove, an a hooked portion perpendicularly disposed at one side of said coupling groove, and a tongue disposed at an opposite side of said coupling groove;

a blade pivoted to said coupling groove of said locating block;

a stopper fixedly fastened to one end of said locating block to stop said blade in said coupling groove of said locating block; and a vane wheel mounted in the water guide chamber of said submerged motor for free rotation relative to said locating block, said vane wheel having a plurality of teeth adapted for engaging said blade to control the direction of rotation of said submerged motor.

4. The submerged motor vane wheel rotation direction control structure as claimed in claim 3 wherein said teeth are radially extended from the shaft of the submerged motor and equiangularly spaced from one another.

5. The submerged motor vane wheel rotation direction control structure as claimed in claim 4 wherein said teeth slopes downwardly inwards.

6. The submerged motor vane wheel rotation direction control structure as claimed in claim 4 wherein said locating block is fixedly mounted on a bearing face portion of an end wall inside said water guide chamber of said submerged motor, said bearing face portion being perpendicularly extended from a straight face portion at a bottom side of a sloping face portion of said end wall.

7. The submerged motor vane wheel rotation direction control structure as claimed in claim 3 wherein said teeth are equiangularly spaced around the periphery of said vane wheel.

8. The submerged motor vane wheel rotation direction control structure as claimed in claim 7 wherein said teeth slopes in one direction.

* * * * *